United States Patent [19]

Cosnard et al.

[11] 4,220,448

[45] Sep. 2, 1980

[54] PROCESS FOR DRY-CLEANING OR DE-OILING BY MEANS OF A PERCHLOROETHYLENE BASE COMPOSITION

[75] Inventors: Jean-Claude Cosnard, Saint Germain les Corbeil; Pierre Sarafinof; Vitat Jean-Claude, both of Antony, all of France

[73] Assignee: Rhone-Poulenc Industries, Paris, France

[21] Appl. No.: 956,626

[22] Filed: Nov. 1, 1978

[30] Foreign Application Priority Data

Jun. 30, 1978 [FR] France ..... 78 19588

[51] Int. Cl.[2] ..... D06L 1/00

[52] U.S. Cl. ..... 8/142; 8/138; 8/139; 8/139.1; 252/171

[58] Field of Search ..... 252/162, 171; 8/142, 8/138, 139, 139.1

[56] References Cited

FOREIGN PATENT DOCUMENTS 693792 7/1953 United Kingdom .

*Primary Examiner*—Melvyn I. Marquis

*Attorney, Agent, or Firm*—McDougall, Hersh & Scott

[57] ABSTRACT

Process for anti-redeposition of staining substances on textiles of natural, synthetic or artificial fibers or mixtures thereof in the course of operations of dry cleaning or de-oiling by means of suitably stabilized perchloroethylene comprising incorporating into the perchloroethylene a sufficient amount of at least one nitroalkane containing from 1 to 4 atoms, as an anti-redeposition additive.

6 Claims, No Drawings

PROCESS FOR DRY-CLEANING OR DE-OILING BY MEANS OF A PERCHLOROETHYLENE BASE COMPOSITION

The present invention concerns a process for dry cleaning and de-oiling textiles, for the purpose of preventing stains from being redeposited on a textile substrate of natural, artificial or synthetic fibers or a mixture of such fibers, and thus holding the soiling or staining substances of the substrate in suspension in the liquid bath in the course of the cleaning or de-oiling operation.

The invention also concerns a perchloroethylene base composition for dry cleaning and de-oiling textiles, for the purpose of preventing the stains on a substrate from being redeposited thereon.

It is known that, when carrying out dry cleaning or de-oiling operations by means of perchloroethylene, on woven or knitted textiles, the stains which are removed from the textiles have a tendency to be redeposited on the textiles, particularly when the perchloroethylene is not regularly regenerated. This accentuates the phenomenon of "greying" of the textiles, which is more easily observed on white or light-colored fabrics.

The fabrics which may be involved in this redeposition are multiple and the complexity of the phenomenon depends mainly on the diversity of the fibers involved in the same cleaning bath and on the hygrometry of the ambient atmosphere.

Various anti-redeposition agents have heretofore been proposed for washing textiles in aqueous medium, in particularly cellulose derivatives.

For the purpose of cleaning in organic solvent medium, it is known from French Pat. No. 1.386.783 and its addition No. 89.341 that certain reinforcing agents have an anti-redeposition action, in particular oxazines or substituted amides having more than 10 carbon atoms.

However, these agents, whether those used in aqueous medium or those used in an organic solvent medium, have the drawback of not being distillable. Accordingly, when regenerating the spent perchloroethylene by distillation, such agents remain at the bottom of the still with the soils or stains and other heavy residual substances, and therefore can no longer be recovered. In other words, these anti-redeposition agents of the prior art must be systematically added to each regeneration operation of the soiled solvent medium.

The object of the present invention is to avoid redeposition thereby markedly to limit the "greying" phenomenon, during the dry cleaning or de-oiling operation of textiles of synthetic, artificial, natural or mixed fibers, while making it possible to recover and re-use the anti-redeposition agent of the invention, by distillation with the perchloroethylene during each bath regeneration stage.

The applicants have surprisely found that it was possible very substantially to reduce the redeposition of staining matter, by using, in suitably stabilized perchloroethylene, compounds selected from the group consisting of nitroalkanes having from 1 to 4 carbon atoms and mixtures thereof.

British Pat. No. 693.792 proposes incorporating a stabilizing amount of a nitroalkane comprising from 1 to 3 carbon atoms and/or its chlorine derivatives, as a stabilization agent for crude perchloroethylene as manufactured, or for purified perchloroethylene in regard to its oxidation on contact with air, or metal surfaces, and/or in the event of its being exposed to light, heat and/or humidity. The stabilizing amount may vary from 0.01 to 1% by weight with respect to the perchloroethylene.

The applicants have observed that, with such a stabilizing amount of nitroalkanes as high as 1% by weight in perchloroethylene, the effect against the "greying" phenomenon of textiles is wholly insufficient and indeed negligible.

The invention therefore concerns a process for antiredeposition of staining substances, when dry cleaning or de-oiling, by means of suitably stabilized perchloroethylene, the process being characterized in that the "greying" phenomenon of the textiles is markedly reduced when a sufficient amount of an additive represented by a nitroalkane having from 1 to 4 carbon atoms or a mixture of at least two such nitroalkanes is added.

Generally, the applicants have found that the desired anti-redeposition effect is apparent when at least 1.25% by weight of the nitroalkane additive is added to the perchloroethylene.

The upper limit of the amount of the nitroalkane additive to be added corresponds to that which results in an undesirable secondary action, such as a perceptible deterioration in the textile fiber, a detrimental effect on colored textiles, a tendency to attack the flexible joints of the dry cleaning or de-oiling apparatus. For example, up to 10% by weight of the nitroalkane additive may very well be added, without observing any harmful secondary effect.

In a preferred form of the invention, the nitroalkane additive used is one that is highly soluble in perchloroethylene, but of very low solubility in water, and its boiling point does not differ by more than 15° C. from the boiling point of perchloroethylene so as to permit co-distillation of the nitroalkane additive with perchloroethylene.

Additives meeting these requirements is represented by nitroethane, nitro-1 propane, 2-nitro propane and mixtures of such compounds with each other.

The applicants have found in fact that very good results in regard to anti-redeposition of soiling material are achieved by adding to the perchloroethylene from 2 to 5% by weight of nitroalkanes having 2 to 3 carbon atoms.

When carrying out operations of regenerating perchloroethylene by distillation of the spent dry-cleaning or de-oiling baths, the nitro-ethane and propane derivatives undergo co-distillation with the perchloroethylene. This makes it possible for the perchloroethylene, which is regenerated in this way, to be re-used directly as an anti-redeposition composition, while substantially preserving its initial composition.

The perchloroethylene may be stabilized by any suitable stabilization agent, in particular those which are compatible with the presence of the $C_1$–$C_4$ nitroalkane additive such as, inter alia, and without this list of compounds being limiting: butylene oxide, tertio-butanol, N-methylpyrrole, n-butanol, diisobutylene, isopropyl acetate and more particularly epichlorohydrin, taken separately or in the form of a mixture of at least two of such compounds.

The anti-redeposition process according to the invention may also include the addition of auxiliary substances which are currently employed in dry cleaning, for example cleaning reinforcing agents represented by anionic, cationic or non-ionic surface active agents, such as: alkylsulphonates, alkylarylsulphonates, more particularly Ca dodecylbenzenesulphonate, products of ethoxylation of fatty alcohols and fatty acids, fatty alcohol sulphates, petroleum sulphonates, alkyl polyglycol ethers, alkylphenol polyglycol ethers, more particularly oxyethylenated nonylphenol having 12 ethylene oxide mols, color brightening agents, finishing agents, antistatic agents and water-proofing agents. Each of these auxiliary substances may be used in the usual proportions, for example, from 1 to 10 g per liter of perchloroethylene-based bath, insofar as it is compatible with the presence of the nitroalkane additive of the invention.

In addition, the process of the invention may comprise the addition of water in proportions which may be up to about 5 to 6% and more particularly from 2 to 3% by weight relative to the textile to be cleaned. The water may originate from the moisture provided by the textiles themselves and/or by the commercial cleaning reinforcing agents which contain between 4 and 30% and usually from 8 to 14% of their weight of water. Occasionally, additional amounts of water are added (about 2 to 4% by weight relative to the textiles to be cleaned) to the cleaning bath containing the reinforcing agents in order to improve the cleaning effect relative to so-called "meager" soiling substances.

The invention also concerns a composition or bath useful in dry cleaning and de-oiling textiles, to prevent "greying" or redeposition of stains on textiles comprising natural, artificial or synthetic fibers or mixtures of such fibers, during the dry cleaning and de-oiling operations, by means of suitably stabilized perchloroethylene, possibly containing up to 6% by weight water with respect to the textiles to be treated and the usual auxiliary substances, more particularly cleaning reinforcing and anti-static agents, each of said auxiliary substances may be present in amounts from 1 to 10 g per liter of said composition, which composition is characterized in that it contains, besides the perchloroethylene and its suitable stabilization agents, from 1.25 to 10% and preferably from 2 to 5% by weight of an additive represented by at least one nitroalkane compound having from 1 to 4 carbon atoms, as an anti-redeposition additive.

In a preferred embodiment of the invention, the composition contains, as the anti-redeposition additive, a compound selected from nitroethane, 1-nitropropane, 2-nitropropane and mixtures thereof.

The mode of operation permitting evaluation of the "greying" phenomenon of textiles, was as follows: a dispersion of 10 g of staining matter in 1 liter of the perchloroethylene-based composition to be tested was prepared by agitation at ambient temperature for 5 minutes in a container.

The staining matter used had the following composition by weight:

| | Parts |
|---|---|
| clay | 7.175 |
| whiting | 2.000 |
| brown iron oxide | 0.125 |
| carbon black | 0.075 |
| wood charcoal | 0.625 |
| sand | 90.000 |

and corresponds to the British Standard B 54088-1766 "Standard Oil CTL/V."

The samples of textiles studied were bleached without finishing and comprised:

100% polyester weighing 268 g/m$^2$

65% polyester 35% cotton mixture weighing 170 g/m$^2$

100% 6/6 polyamide weighing 170 g/m$^2$

100% polyacrylonitrile (registered trademark Crylor) weighing 230 g/m$^2$

100% wool weighing 178 g/m$^2$.

These samples were kept for 48 hours in a room maintained at a temperature of 20° C. and 65% relative humidity, and stored in closed containers until the moment of the test.

A sample piece of 3.4 g of each of the five textiles mentioned above was then introduced into a miniature-size dry cleaning machine which was set in operation.

Without stopping the machine, the staining matter prepared as indicated above was then poured onto the textile samples, and operation was continued at a bath temperature of about 25° C. for a period of 5 minutes, before centrifuging for 10 seconds. The samples were dried for 10 minutes at a temperature of 60° C.

Each of the samples treated in this way, and "greyed" to a greater or lesser extent, was subjected to an operation of determining the reflectance index by means of the "Reflection meter 670" of the company "Photovolt" (United States of America) provided with a green filter.

The apparatus was set up to 100 for each bleached but untreated textile, and a reflectance index was measured for each "greyed" sample.

The figure value of the "greying" phenomenon is represented by the difference between 100 and the value of the reflectance index measured for each sample. The less the "greying" phenomenon, the closer this index will be to the value of 100.

In the following examples which illustrate the various aspects of the invention in non-limiting manner, the stated percentages of the components of the various compositions are expressed by weight.

EXAMPLES 1 to 6

Using the mode of operation set out above, the "anti-greying" effect or anti-redeposition effect of various compositions based on initially stabilized perchloroethylene, in which different proportions of nitroethane, 1-nitropropane and/or 2-nitro propane were incorporated, is examined.

The starting perchloroethylene was stabilized by 0.02% of epichlorohydrin and 0.002% of N-methylpyrrole.

Following Table I summarizes the results obtained. This table also shows a reference test carried out with a composition which did not contain nitroalkane according to the invention.

TABLE I

| Examples | Composition in % by wt. | Fiber | 100% polyester | 65/35 polyester cotton | 100% 6/6 polyamide | 100% polyacrylonitrile | 100% wool |
|---|---|---|---|---|---|---|---|
| | | | Measure of reflectance index | | | | |

TABLE I-continued

| Examples | Composition in % by wt. | Fiber | 100% polyester | 65/35 polyester cotton | 100% 6/6 polyamide | 100% polyacrylonitrile | 100% wool |
|---|---|---|---|---|---|---|---|
| Reference | Stabilized perchloroethylene | 100 | 52 | 80 | 68 | 61 | 81 |
| 1 | Stabilized perchloroethylene | 96 | 89 | 88 | 93 | 72 | 92 |
| | nitroethane | 4 | | | | | |
| 2 | Stabilized perchloroethylene | 96 | 81 | 84 | 89 | 71 | 87 |
| | 1-nitropropane | 4 | | | | | |
| 3 | Stabilized perchloroethylene | 96 | 80 | 88 | 93 | 73 | 90 |
| | 2-nitropropane | 4 | | | | | |
| 4 | Stabilized perchloroethylene | 96 | | | | | |
| | nitroethane | 1 | 83 | 86 | 92 | 71 | 90 |
| | 1-nitropropane | 1 | | | | | |
| | 2-nitropropane | 2 | | | | | |
| 5 | Stabilized perchloroethylene | 96 | 80 | 85 | 91 | 70 | 89 |
| | 1-nitropropane | 2 | | | | | |
| | 2-nitropropane | 2 | | | | | |
| 6 | Stabilized perchloroethylene | 96 | 88 | 88 | 93 | 73 | 90 |
| | nitroethane | 2 | | | | | |
| | 2-nitropropane | 2 | | | | | |

These results show a marked improvement in anti-redeposition when the nitroalkanes of the invention are incorporated in the stabilized perchloroethylene, compared to stabilized perchloroethylene which does not contain nitroethane, 1-nitropropane and/or 2-nitropropane as an anti-redeposition additive.

EXAMPLES 7 to 10

Operation was similar to Examples 1 to 6, except that a mixture of cleaning reinforcing agents having the following composition was also added to the perchloroethylene-based bath:

| | % |
|---|---|
| oxyethylenated nonylphenol having 12 ethylene oxide mols | 32 |
| calcium dodecyl benzenesulphonate (with 30% water) | 43 |
| polyglycol having a mean molecular weight of about 300 | 5 |
| butylglycol | 20 |

The water added to the bath (apart from the water provided by the reinforcing agents and the textiles) represents about 0.8 g/l of bath, which corresponds approximately to a water content of 4% relative to the fibers. The results observed are set forth in the following Table II, which also shows corresponding reference tests performed with compositions not containing the nitroalkanes of the invention.

TABLE II

| Examples | Initial bath composition | Fiber | 100% polyester | 65/35 polyester-cotton | 100% 6/6 polyamide | 100% polyacrylonitrile | 100% wool |
|---|---|---|---|---|---|---|---|
| | | | Measure of reflectance index | | | | |
| Reference | Stabilized perchloroethylene | 100 | 52 | 80 | 68 | 61 | 81 |
| Reference | Stabilized perchloroethylene | 100 | | | | | |
| | Cleaning reinforcing agts | 2 g/l | 58 | 70 | 74 | 71 | 76 |
| Reference | Stabilized perchloroethylene | 100 | | | | | |
| | Cleaning reinforcing agts | 2 g/l | 76 | 74 | 80 | 74 | 74 |
| | water | 0.8 g/l | | | | | |
| 7 | Stabilized perchloro- | | | | | | |

TABLE II-continued

| Examples | Initial bath composition | Fiber | 100% polyester | 65/35 polyester-cotton | 100% 6/6 polyamide | 100% polyacrylonitrile | 100% wool |
|---|---|---|---|---|---|---|---|
| | ethylene | 96 | | | | | |
| | 2-nitropropane | 4 | 82 | 83 | 89 | 83 | 89 |
| | Cleaning reinforcing agts | 2 g/l | | | | | |
| 8 | Stabilized perchloroethylene | 96 | | | | | |
| | 1-nitropropane | 4 | 78 | 85 | 89 | 83 | 90 |
| | Cleaning reinforcing agts | 2 g/l | | | | | |
| | water | 0.8 g/l | | | | | |
| 9 | Stabilized perchloroethylene | 96 | | | | | |
| | 2-nitropropane | 2 | | | | | |
| | 1-nitropropane | 1 | 80 | 82 | 89 | 80 | 89 |
| | nitroethane | 1 | | | | | |
| | Cleaning reinforcing agents | 2 g/l | | | | | |
| 10 | Composition of Example 9 | 100 | 78 | 84 | 88 | 80 | 89 |
| | water | 0.8 g/l | | | | | |

It will be seen that with the compositions of Examples 7 and 9, the results obtained are very good, taking into account the very large amount of staining substances added relative to the weight of textiles treated.

In the presence of water (composition of Examples 8 and 10), the results remain substantially the same as those obtained with the compositions of Examples 7 and 9.

On the basis of these results, it will be seen that the addition of reinforcing agents to the stabilized perchloroethylene alone is not capable of improving the anti-redeposition properties of the bath, except, and on average to a small v extent, in the case of the synthetic fibers. In the presence of reinforcing agents and water, the good results obtained with the compositions of Examples 8 and 10 are at least maintained if not improved, as is the case for wool.

EXAMPLES 11 to 14

These examples illustrate the continuous de-oiling of knitted articles. In order to facilitate the knitting of such fibers as 100% polyester, 100% polyacrylonitrile, 100% wool, polyamide, polyester-cotton, they are coated with mineral oils (synthetic fibers) or oleins (wool). These fibers are knitted on industrial looms and issue in a tubular form.

The staining on these knitted articles essentially results from the dust on the floors when the articles fall from the carriages or the looms.

These knitted articles are de-oiled discontinuously in the same manner as for the dry-cleaning operation. For this purpose, use is made of dry-cleaning machines of large capacity (from 50 to 150 kg of working load) with stabilized perchloroethylene, as in Examples 1 to 6, without the addition of cleaning reinforcing agent or water, in which the nitroalkanes of the invention are incorporated.

Table III hereinafter shows the results obtained.

TABLE III

| Examples | Initial both composition | Fiber | 100% polyester | 65/35 polyester-cotton | 100% 6/6 polyamide | 100% polyacrylonitrile | 100% wool |
|---|---|---|---|---|---|---|---|
| | | | Measure of reflectance index | | | | |
| Reference | Stabilized perchloroethylene | 100 | 71 | 82 | 75 | 66 | 85 |
| 11 | Stabilized perchloroethylene | 96 | 91 | 90 | 94 | 74 | 93 |
| | nitroethane | 4 | | | | | |
| 12 | Stabilized perchloroethylene | 96 | 83 | 88 | 93 | 72 | 90 |
| | 1-nitropropane | 4 | | | | | |
| 13 | Stabilized perchloroethylene | 96 | 85 | 90 | 94 | 76 | 92 |
| | 2-nitropropane | 4 | | | | | |
| 14 | Stabilized perchloroethylene | 96 | | | | | |
| | nitroethane | 1 | 89 | 90 | 93 | 74 | 82 |
| | 1-nitropropane | 1 | | | | | |

TABLE III-continued

| Examples | Initial both composition | Fiber | 100% polyester | 65/35 polyester-cotton | 100% 6/6 polyamide | 100% polyacrylonitrile | 100% wool |
|---|---|---|---|---|---|---|---|
| | 2-nitropropane | 2 | | | | | |

This table shows the significant improvement in respect of anti-redeposition when nitroalkanes of the invention are incorporated in the stabilized perchloroethylene, relative to the reference comprising stabilized perchloroethyelene alone.

We claim:

1. A process for anti-redeposition of greying factors on textiles of natural, synthetic or artificial fibers or mixtures thereof, comprising dry cleaning or de-oiling the textile by means of stabilized perchloroethylene, containing 1.25–10% by weight of at least one nitroalkane compound having from 1 to 4 carbon atoms.

2. A process as claimed in claim 1, in which the nitroalkane is selected from the group consisting nitroethane, 1-nitropropane, 2-nitropropane and mixtures thereof.

3. A process as claimed in claim 1, in which the nitroalkane is incorporated in an amount from 2 to 5% by weight in the perchloroethylene.

4. An anti-redeposition composition for dry cleaning or de-oiling based on stabilized perchloroethylene which may possibly contain water in an amount up to 6% by weight relative to the textiles to be treated, characterized in that 1.25 to 10% by weight of at least one nitroalkane compound having from 1 to 4 carbon atoms is present in the composition.

5. An anti-redeposition composition as claimed in claim 4, in which the nitroalkane is present in the composition in an amount from 2 to 5% by weight of the composition.

6. An anti-redeposition composition as claimed in claim 4, in which the nitroalkane additive is selected from the group consisting of nitroethane, 1-nitropropane, 2-nitropropane and mixtures thereof.

* * * * *